US010377961B2

(12) United States Patent
Ng et al.

(10) Patent No.: US 10,377,961 B2
(45) **Date of Patent: *Aug. 13, 2019**

(54) LUBRICANT COMPOSITIONS CONTAINING CONTROLLED RELEASE ADDITIVES

(71) Applicant: ExxonMobil Research and Engineering Company, Annandale, NJ (US)

(72) Inventors: Man Kit Ng, Basking Ridge, NJ (US); Anne Marie Shough, Conroe, TX (US); Hong Cheng, Bridgewater, NJ (US); Joseph R. Pellettiere, Hillside, NJ (US); Peter Calcavecchio, Milford, NJ (US); Shane Deighton, Bound Brook, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 216 days.

This patent is subject to a terminal disclaimer.

(21) Appl. No.: 15/426,334

(22) Filed: Feb. 7, 2017

(65) Prior Publication Data

US 2017/0247626 A1 Aug. 31, 2017

Related U.S. Application Data

(60) Provisional application No. 62/300,125, filed on Feb. 26, 2016.

(51) Int. Cl.

| | |
|---|---|
| ***C10M 129/84*** | (2006.01) |
| ***C10M 133/12*** | (2006.01) |
| ***C10M 141/06*** | (2006.01) |

(52) U.S. Cl.

CPC ..... *C10M 129/84* (2013.01); *C10M 133/12* (2013.01); *C10M 141/06* (2013.01); *C10M 2203/045* (2013.01); *C10M 2203/1065* (2013.01); *C10M 2205/0206* (2013.01); *C10M 2205/0285* (2013.01); *C10M 2205/223* (2013.01); *C10M 2207/02* (2013.01); *C10M 2207/023* (2013.01); *C10M 2207/026* (2013.01); *C10M 2207/04* (2013.01); *C10M 2207/28* (2013.01); *C10M 2207/283* (2013.01); *C10M 2207/289* (2013.01); *C10M 2207/32* (2013.01); *C10M 2215/064* (2013.01); *C10M 2215/08* (2013.01); *C10M 2215/10* (2013.01); *C10M 2215/102* (2013.01); *C10M 2217/043* (2013.01); *C10M 2219/042* (2013.01); *C10M 2219/044* (2013.01); *C10M 2223/04* (2013.01); *C10M 2223/049* (2013.01); *C10M 2223/06* (2013.01); *C10M 2229/041* (2013.01); *C10M 2229/046* (2013.01); *C10N 2230/02* (2013.01); *C10N 2230/04* (2013.01); *C10N 2230/10* (2013.01); *C10N 2230/12* (2013.01); *C10N 2230/14* (2013.01); *C10N 2230/18* (2013.01); *C10N 2230/36* (2013.01); *C10N 2240/10* (2013.01); *C10N 2250/02* (2013.01)

(58) Field of Classification Search

CPC ..... C10N 2230/02; C10N 223/10; C10N 2230/04; C10N 2230/12; C10N 2230/14; C10N 2230/36; C10N 2230/18; C10N 2250/02; C10M 2215/064; C10M 2207/32

USPC ..... 508/506

See application file for complete search history.

(56) References Cited

U.S. PATENT DOCUMENTS

| | | | |
|---|---|---|---|
| 1,815,022 | A | 7/1931 | Davis |
| 2,015,748 | A | 10/1935 | Frolich |
| 2,191,498 | A | 2/1940 | Reiff |
| 2,387,501 | A | 10/1945 | Dietrich |
| 2,655,479 | A | 10/1953 | Munday et al. |
| 2,666,746 | A | 1/1954 | Munday et al. |
| 2,721,877 | A | 10/1955 | Popkin et al. |
| 2,721,878 | A | 10/1955 | Popkin |
| 3,036,003 | A | 5/1962 | Verdol |
| 3,087,936 | A | 4/1963 | Le Suer |

(Continued)

FOREIGN PATENT DOCUMENTS

| | | | |
|---|---|---|---|
| CA | 1094044 | A | 1/1981 |
| CN | 102101869 | A | 6/2011 |
| EP | 0976809 | A2 | 9/1992 |
| EP | 0471071 | B1 | 8/1995 |
| JP | 2004157231 | | 11/2002 |
| JP | 2013253170 | | 12/2013 |
| WO | 98/26030 | A1 | 12/1997 |
| WO | 99/47629 | A1 | 9/1999 |

(Continued)

OTHER PUBLICATIONS

The International Search Report and Written Opinion of PCT/US2017/016796 dated Apr. 12, 2017.

(Continued)

*Primary Examiner* — Vishal V Vasisth

(74) *Attorney, Agent, or Firm* — Robert A. Migliorini

(57) ABSTRACT

A lubricating oil including a lubricating oil base stock as a major component; and a mixture of (i) one or more protected lubricating oil additives having a first performance function, and (ii) one or more unprotected lubricating oil additives having a second performance function, as a minor component. The first performance function and the second performance function are the same. The one or more protected lubricating oil additives are inactive with respect to their performance function. The one or more protected lubricating oil additives are converted into one or more unprotected lubricating oil additives in the lubricating oil in-service in an engine or other mechanical component. A method for controlled release of one or more lubricating oil additives into a lubricating oil. A method for improving oxidative stability of a lubricating oil and extending performance life of one or more lubricating oil additives.

18 Claims, No Drawings

(56) References Cited

U.S. PATENT DOCUMENTS

| | | | |
|---|---|---|---|
| 3,172,892 | A | 3/1965 | LeSuer et al. |
| 3,200,107 | A | 8/1965 | Le Suer |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | LeSuer |
| 3,272,746 | A | 9/1966 | Le Suer et al. |
| 3,275,554 | A | 9/1966 | Wagenaar |
| 3,316,177 | A | 4/1967 | Dorer, Jr. |
| 3,322,670 | A | 5/1967 | Burt et al. |
| 3,329,658 | A | 7/1967 | Fields |
| 3,341,542 | A | 9/1967 | Le Suer et al. |
| 3,382,291 | A | 5/1968 | Brennan |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | van der Voort et al. |
| 3,454,607 | A | 7/1969 | Le Suer et al. |
| 3,519,565 | A | 7/1970 | Coleman |
| 3,541,012 | A | 11/1970 | Stuebe |
| 3,565,804 | A | 2/1971 | Honnen et al. |
| 3,595,791 | A | 7/1971 | Cohen |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,703,536 | A | 11/1972 | Piasek et al. |
| 3,704,308 | A | 11/1972 | Piasek et al. |
| 3,725,277 | A | 4/1973 | Worrel |
| 3,725,480 | A | 4/1973 | Traise et al. |
| 3,726,882 | A | 4/1973 | Traise et al. |
| 3,742,082 | A | 6/1973 | Brennan |
| 3,751,365 | A | 8/1973 | Piasek et al. |
| 3,755,433 | A | 8/1973 | Miller et al. |
| 3,756,953 | A | 9/1973 | Piasek et al. |
| 3,769,363 | A | 10/1973 | Brennan |
| 3,787,374 | A | 1/1974 | Adams |
| 3,798,165 | A | 3/1974 | Piasek et al. |
| 3,803,039 | A | 4/1974 | Piasek et al. |
| 3,822,209 | A | 7/1974 | Knapp et al. |
| 3,876,720 | A | 4/1975 | Heilman et al. |
| 3,948,800 | A | 4/1976 | Meinhardt |
| 4,066,559 | A | 1/1978 | Rohde |
| 4,075,098 | A | 2/1978 | Paul et al. |
| 4,100,082 | A | 7/1978 | Clason et al. |
| 4,149,178 | A | 4/1979 | Estes |
| 4,218,330 | A | 8/1980 | Shubkin |
| 4,234,435 | A | 11/1980 | Meinhardt et al. |
| 4,239,930 | A | 12/1980 | Allphin et al. |
| 4,367,352 | A | 1/1983 | Watts, Jr. et al. |
| 4,413,156 | A | 11/1983 | Watts, Jr. et al. |
| 4,426,305 | A | 1/1984 | Malec |
| 4,434,408 | A | 2/1984 | Baba et al. |
| 4,454,059 | A | 6/1984 | Pindar et al. |
| 4,612,132 | A | 9/1986 | Wollenberg et al. |
| 4,747,965 | A | 5/1988 | Wollenberg et al. |
| 4,767,551 | A | 8/1988 | Hunt et al. |
| 4,795,583 | A | 1/1989 | Papay |
| 4,798,684 | A | 1/1989 | Salomon |
| 4,827,064 | A | 5/1989 | Wu |
| 4,827,073 | A | 5/1989 | Wu |
| 4,910,355 | A | 3/1990 | Shubkin et al. |
| 4,956,122 | A | 9/1990 | Watts et al. |
| 4,992,184 | A | 2/1991 | Horodysky et al. |
| 5,068,487 | A | 11/1991 | Theriot |
| 5,084,197 | A | 1/1992 | Galic et al. |
| 5,326,486 | A | 7/1994 | Mizui et al. |
| 5,705,458 | A | 1/1998 | Roby et al. |
| 5,824,627 | A | 10/1998 | McConnachie et al. |
| 5,837,657 | A | 11/1998 | Fang et al. |
| 5,906,968 | A | 5/1999 | McConnachie et al. |
| 6,010,987 | A | 1/2000 | Stiefel et al. |
| 6,110,878 | A | 8/2000 | McConnachie et al. |
| 6,143,701 | A | 11/2000 | Boffa |
| 6,153,564 | A | 11/2000 | Arunasalam et al. |
| 6,176,094 | B1 | 1/2001 | Ohta et al. |
| 6,268,317 | B1 | 7/2001 | Kawakami et al. |
| 6,569,820 | B2 | 5/2003 | McConnachie et al. |
| 6,689,725 | B1 | 2/2004 | Gao |
| 6,730,638 | B2 | 5/2004 | Farng et al. |
| 6,734,150 | B2 | 5/2004 | Gao et al. |
| 6,843,916 | B2 | 1/2005 | Burlington et al. |
| 8,604,233 | B2 | 12/2013 | Omura et al. |
| 2009/0291865 | A1 | 11/2009 | Brennan et al. |
| 2010/0294499 | A1 | 11/2010 | Lewis et al. |
| 2011/0269656 | A1* | 11/2011 | Burrington ..... B01J 13/0065 508/462 |
| 2014/0087982 | A1* | 3/2014 | Calcavecchio ..... B01J 13/14 508/170 |
| 2017/0073610 | A1* | 3/2017 | Hsu ..... B01J 13/14 |

FOREIGN PATENT DOCUMENTS

| | | | |
|---|---|---|---|
| WO | 99/66013 | A1 | 12/1999 |
| WO | 2015083605 | A1 | 11/2015 |
| WO | 2015175947 | A1 | 11/2015 |

OTHER PUBLICATIONS

The International Search Report and Written Opinion of PCT/US2017/016792 dated May 16, 2017.

Varala, et al. "Molecular Iodine-Catalyzed Facile Procedure for N-Boc Protection of Amines", J. Org. Chem., vol. 71, No. 21, 2006.

* cited by examiner

LUBRICANT COMPOSITIONS CONTAINING CONTROLLED RELEASE ADDITIVES

CROSS-REFERENCE TO RELATED APPLICATIONS

This application claims priority to U.S. Provisional Application Ser. No. 62/300,125 filed Feb. 26, 2016, which is herein incorporated by reference in its entirety. This application is related to one other co-pending U.S. application Ser. No. 15/426,321, filed on even date herewith, entitled "Lubricant Compositions Containing Controlled Release Additives". This co-pending U.S. application is hereby incorporated by reference herein in its entirety.

FIELD

This disclosure relates to lubricant compositions containing controlled release additives. This disclosure also relates to a method for controlled release of one or more lubricating oil additives into a lubricating oil. This disclosure further relates to a mixture composition comprising (i) one or more protected lubricating oil additives (e.g., a protected phenolic antioxidant), and (ii) one or more unprotected lubricating oil additives (e.g., an unprotected aminic antioxidant). This disclosure yet further relates to a method for improving oxidative stability of a lubricating oil and extending performance life of one or more lubricating oil additives.

BACKGROUND

The performance of a lubricant degrades over time, which defines its specified oil drain interval. The degradation rate of a lubricant is dependent up the rate at which the activity of the additives contained in the lubricant degrades over time. Conventional ways in approaching this challenge is by developing or identifying additives that are more robust or more oxidatively stable so that they can persist longer in the lubricant environment, however this can often come at the cost of additive performance. Alternatively, lubricants formulations contain higher treat rates of the additives with the hopes of extended the performance of that additive longer. But this is often difficult as lubricant formulations are a delicate balance of additives and overtreating one additive can have significant negative impacts on the performance of another.

Time release additives for engine oils are known. These additives are typically incorporated into thermoplastic polymers which slowly dissolve into the engine oil. See, for example, U.S. Pat. No. 4,075,098. Time release additives have also been incorporated into polymers which are oil-permeable at elevated engine temperatures. See, for example, U.S. Pat. No. 4,066,559.

Replenishment of additives in a lubricant, by using a controlled release gel or other means to add additional additive to the lubricant, can improve the performance of the lubricant and the device using the lubricant. Use of controlled release gels, as described in U.S. Pat. No. 6,843,916, can replenish a lubricant with fresh additives over time. Such gels are formed by incorporating additive components which are compatible with the functional fluid to which the additive is to be delivered into a gel matrix. These gel matrixes often result from the interaction of a basic component and an acidic component, forming the gel.

There is a need for extending the life of current lubricant additives without compromising on additive performance and without increasing the initial treat rate of active additive.

In addition, there is a need for improving the solubility of additives in lubricants, thereby reducing the need for cobase stocks (e.g., alkylated naphthalene such as AN5 or polar esters) or providing a mechanism to stabilize less soluble additives in lubricant formulations.

SUMMARY

This disclosure relates to lubricant compositions containing controlled release additives. This disclosure also relates to a method for controlled release of one or more lubricating oil additives into a lubricating oil. This disclosure further relates to a composition comprising a mixture of (i) one or more protected lubricating oil additives (e.g., a protected phenolic antioxidant), and (ii) one or more unprotected lubricating oil additives (e.g., an unprotected aminic antioxidant). This disclosure yet further relates to a method for improving oxidative stability of a lubricating oil and extending performance life of one or more lubricating oil additives.

This disclosure also relates in part to a lubricating oil comprising a lubricating oil base stock as a major component; and a mixture of (i) one or more protected lubricating oil additives comprising a protected phenolic antioxidant, and (ii) one or more unprotected lubricating oil additives comprising an unprotected aminic antioxidant, as a minor component. The one or more protected lubricating oil additives are inactive with respect to their antioxidant function. The one or more protected lubricating oil additives are converted into one or more unprotected lubricating oil additives in the lubricating oil in-service in an engine or other mechanical component.

This disclosure further relates in part to a method for controlled release of one or more lubricating oil additives into a lubricating oil. The method comprises using as the lubricating oil a formulated oil, the formulated oil having a composition comprising a lubricating oil base stock as a major component; and a mixture of (i) one or more protected lubricating oil additives comprising a protected phenolic antioxidant, and (ii) one or more unprotected lubricating oil additives comprising an unprotected aminic antioxidant, as a minor component. The one or more protected lubricating oil additives are inactive with respect to their antioxidant function. The method comprises converting the one or more protected lubricating oil additives into one or more unprotected lubricating oil additives in the lubricating oil in-service in an engine or other mechanical component.

This disclosure yet further relates in part to a method for improving oxidative stability of a lubricating oil and extending performance life of one or more lubricating oil additives. The method comprises using as the lubricating oil a formulated oil, the formulated oil having a composition comprising a lubricating oil base stock as a major component; and a mixture of (i) one or more protected lubricating oil additives comprising a protected phenolic antioxidant, and (ii) one or more unprotected lubricating oil additives comprising an unprotected aminic antioxidant, as a minor component. The one or more protected lubricating oil additives are inactive with respect to their antioxidant function. The method comprises converting the one or more protected lubricating oil additives into one or more unprotected lubricating oil additives in the lubricating oil in-service in an engine or other mechanical component.

This disclosure also relates in part to a composition comprising a mixture of (i) one or more protected lubricating oil additives comprising a protected phenolic antioxidant, and (ii) one or more unprotected lubricating oil additives comprising an unprotected aminic antioxidant.

It has been surprisingly found that a lubricating oil having a mixture of (i) one or more protected lubricating oil additives comprising a protected phenolic antioxidant, and (ii) one or more unprotected lubricating oil additives comprising an unprotected aminic antioxidant, exhibits improved oxidative protection and extended additive performance life.

Other objects and advantages of the present disclosure will become apparent from the detailed description that follows.

DETAILED DESCRIPTION

Definitions

All numerical values within the specification and the claims herein are modified by "about" or "approximately" the indicated value, and take into account experimental error and variations that would be expected by a person having ordinary skill in the art.

"Other mechanical component" within the specification and the claims herein includes, but is not limited to, a power train, a driveline, a transmission, a gear, a gear train, a gear set, a compressor, a pump, a hydraulic system, a bearing, a bushing, a turbine, a piston, a piston ring, a cylinder liner, a cylinder, a cam, a tappet, a lifter, a gear, a valve, or a bearing including a journal, a roller, a tapered, a needle, or a ball bearing.

"Over time" within the specification and the claims herein means a typical service life for a lubricant, or 6,000 miles for an engine oil, or alternatively 100 service hours for an engine oil.

"Extending performance life" or "extended performance life" of one or more lubricating oil additive within the specification and the claims herein means an increase in the expected performance life of the one or more lubricating oil additives by 50%, or preferably by 100%, or more preferably by 200%, or even more preferably by 300%.

"Unprotected active groups" or "active groups" within the specification and the claims herein means the part of a lubricating oil additive which is known to contribute to the primary performance function of the particular lubricating oil additive. Active groups or unprotected active groups include, for example, an —OH group for friction modifier additives or antioxidant additives. Another example is a —NH group for antioxidant additives or dispersant additives.

"Protected active groups" within the specification and the claims herein means the chemical protection of an active group or unprotected active group of a lubricating oil additive, whereby protection of the active group or unprotected active group results in the lubricating oil additive being inactive to its primary performance function.

"Conversion of protected to unprotected active groups" within the specification and the claims herein means the conversion of a protected active group to an active group or unprotected active group of a lubricating oil additive by chemical deprotection of the protected active group, whereby the resulting lubricating oil additive is made active with respect to its primary performance function.

"Unprotected lubricating oil additives" within the specification and the claims herein means a lubricating oil additive which is able to contribute to its primary performance function.

"Protected lubricating oil additives" within the specification and the claims herein means a lubricating oil additive which is unable to contribute to its primary performance function, whereby protection of the lubricating oil additives can be through physical protection or chemical protection.

"Conversion of protected to unprotected lubricating oil additives" within the specification and the claims herein means the conversion of a protected lubricating oil additive to an unprotected lubricating oil additive by chemical deprotection or physical deprotection, whereby the resulting lubricating oil additive is made active with respect to its primary performance function.

Exemplary Embodiments

This disclosure provides a lubricating oil comprising a lubricating oil base stock as a major component; and a mixture of (i) one or more protected lubricating oil additives comprising a protected phenolic antioxidant, and (ii) one or more unprotected lubricating oil additives comprising an unprotected aminic antioxidant, as a minor component. The one or more protected lubricating oil additives are inactive with respect to their antioxidant function. The one or more protected lubricating oil additives are converted into one or more unprotected lubricating oil additives in the lubricating oil in-service in an engine or other mechanical component.

The one or more protected lubricating oil additives are converted to one or more unprotected lubricating oil additives in the lubricating oil in-service in the engine or other mechanical component at a temperature greater than or equal to 110° C., or by reaction with free acids that catalyze the release of an unprotected lubricating oil additive at a temperature greater than or equal to ambient temperature.

Illustrative unprotected lubricating oil additives include, for example, additives containing an —OH active group, a —NH active group, and the like.

Protection methods for the one or more protected lubricating oil additives can include, for example, chemical protection or physical protection. Illustrative chemical protection includes, for example, converting an unprotected active —OH group or —NH group to a protected carbonate, carbamate, acetal, ester, amide, urea, alkoxysilane, alkylsilane, phosphite, phosphonate, phosphate, sulfonamide, sulfonate, or sulfate group. Illustrative physical protection includes, for example, incorporating one or more unprotected lubricating oil additives into swollen inverse micelles, or incorporating one or more unprotected lubricating oil additives into a stable polar emulsion.

In an embodiment, one or more protected lubricating oil additives include one or more unprotected lubricating oil additives incorporated into swollen inverse micelles dispersed in a nonpolar lubricating oil base stock. Illustrative swollen inverse micelles comprise (i) a liquid polar core containing a polar solvent and one or more polar unprotected lubricating oil additives having solubility in the polar solvent, and (ii) a layer of liquid surfactant molecules enclosing the liquid polar core in which polar heads of the liquid surfactant molecules are oriented towards the liquid polar core.

This disclosure utilizes inverse micelle technology for lubricants, which provides for the incorporation of submicron spheres of an insoluble polar solvent into a nonpolar base stock. The inverse dispersed spheres provide the advantage of forming thick lubricating films while the surrounding base stock provides a relatively low overall viscosity to the oil. The polar solvent can also be used to dissolve polar additives which are not soluble in the base stock and/or incorporate higher concentrations of additives which have low solubility in the base stock.

This inverse micellar system can be used to efficiently transport polar molecules with a higher viscosity than the base stock to the contacts requiring elastohydrodynamic lubrication such as journal bearings. This system can be further used to solubilize, and carry in the base stock, surface active ingredients such as friction modifiers, anti-wear additives and antioxidants critical to all lubricated contacts. In an embodiment, the surfactant protective coating of the dispersed swollen inverse micelles also efficiently provides self-healing properties (e.g., when swollen inverse micelles are sheared, the micelles spontaneously reform at a smaller size).

In accordance with this disclosure, there is provided a procedure of incorporating hydrocarbon insoluble compounds into lubricant formulations. It also provides a protective system of swollen inverse micelles to carry additives and efficiently deliver them in the high shear environment of the lubricated contact. These polar lubricating oil additives can be designed to impart better friction, anti-wear and antioxidant properties to the lubricant.

An additional benefit of this disclosure is the polar hydrocarbon carrier (i.e., polar solvent) in which the additive is dissolved. The viscosity of this carrier can be maximized to provide a shear triggered protective film at the lubricated contact. The inverse micellization of the high viscosity carrier provides the benefit of high film thickness within a relatively low viscosity lubricant. Furthermore, the polar hydrocarbon core can provide other benefits such as trapping and neutralizing acids formed during the oils use and providing a means to increase the thermal conductivity of the oil.

The lubricating engine oils of this disclosure can also be useful for applications irrespective of viscosity grade and/or base stock type. For example, the lubricating engine oils of this disclosure can be useful in automotive, marine, aviation, and industrial engine and machine components. The inverse micellar system of this disclosure can be used for a variety of applications, for example, isolating reactive additives, trapping water in lubricants, and the like. The lubricating oils of this disclosure can also be useful for lubricating machine components such as industrial paper machines, metal working tools, compressors, bearing greases, wind turbines, and the like.

In particular, this disclosure relates to inverse micelle compositions including a core containing one or more polar solvents and one or more unprotected lubricating oil additives in the swollen inverse micelles and in which the inverse micelles are dispersed in one or more lubricating base oils of mineral, synthetic or natural origin, and a liquid surfactant or liquid surfactant/polymer shell. This disclosure also relates to lubricating oils including the inverse micellar compositions. This disclosure further relates to the use of inverse micellar compositions as anti-wear, antioxidant and/or friction modifier additives for lubricant compositions.

Inverse micellization is a process via which a product is enclosed in inverse micelles comprising a liquid surfactant or liquid surfactant/polymeric shell or membrane (typically polymeric) enclosing a liquid core containing the product. These inverse micelles have a diameter typically between 0.01 and 1000 μm. Depending on the particular molecules, applications are found in the areas of agriculture (fertilizers, pesticides), health (medications), cosmetics, textiles, and the like.

In an embodiment, one or more protected lubricating oil additives include one or more unprotected lubricating oil additives incorporated into a stable polar emulsion in a nonpolar lubricating oil base stock. Illustrative stable polar emulsions comprise a liquid polar core containing a polar solvent and one or more unprotected polar lubricating oil additives having solubility in the polar solvent.

Deprotection methods for converting one or more protected lubricating oil additives to one or more unprotected lubricating oil additives include chemical deprotection or physical deprotection.

Illustrative chemical deprotection methods include, for example, converting a protected carbonate, carbamate, acetal, ester, amide, urea, alkoxysilane, alkylsilane, phosphite, phosphonate, phosphate, sulfonamide, sulfonate, or sulfate group to an unprotected —OH group or —NH group.

Illustrative physical deprotection methods include, for example, releasing the one or more unprotected lubricating oil additives from the (i) swollen inverse micelles or (ii) stable polar emulsion. The one or more unprotected lubricating oil additives in the (i) swollen inverse micelles or (ii) stable polar emulsions are released into the lubricating oil, for example, through diffusion, thermal/oxidative degradation of the (i) swollen inverse micelles or (ii) stable polar emulsions, deformation of the (i) swollen inverse micelles or (ii) stable polar emulsions through high pressures or shear stress, and the like.

Preferred protected lubricating oil additives include a protected phenolic antioxidant, and preferred unprotected lubricating oil additives include an unprotected aminic antioxidant.

Illustrative protected lubricating oil additives include, for example, a protected hydroxyl-based organic friction modifier, a protected aminic antioxidant, a protected phenolic antioxidant, a protected Mannich dispersant, a protected ester diol friction modifier, and the like.

Other illustrative protected lubricating oil additives include, for example, a protected hydroxyl-based organic friction modifier comprising tert-butyl octadecane-1,2-diyl dicarbonate, a protected aminic antioxidant comprising tert-butyl diaryl carbamate, a protected phenolic antioxidant comprising di-tert-butyl (methylenebis(2,6-di-tert-butyl-4,1-phenylene)) bis(carbonate), a protected Mannich dispersant comprising a Mannich dispersant having a tert-butyl carbonate group, a protected ester diol friction modifier comprising glycerol monostearate bis(carbonate), and the like.

The lubricating oils of this disclosure can further include one or more unprotected lubricating oil additives. Illustrative of such unprotected lubricating oil additives include, for example, an unprotected viscosity improver, an unprotected antioxidant, an unprotected detergent, an unprotected dispersant, an unprotected pour point depressant, an unprotected corrosion inhibitor, an unprotected friction modifier, an unprotected metal deactivator, an unprotected seal compatibility additive, an unprotected anti-foam agent, an unprotected inhibitor, and an unprotected anti-rust additive.

In the lubricating oils of this disclosure, the lubricating oil base stock can be present in an amount from 70 weight percent to 95 weight percent, and the mixture of (i) one or more protected lubricating oil additives and (ii) one or more unprotected lubricating oil additives can be present in an amount from 0.1 weight percent to 10 weight percent or greater, based on the total weight of the lubricating oil.

The lubricating oils of this disclosure can be used in automotive, marine, aviation, industrial engine and machine component applications, and the like.

As described herein, this disclosure provides a method for controlled release of one or more lubricating oil additives into a lubricating oil. The method comprises using as the lubricating oil a formulated oil, the formulated oil having a composition comprising a lubricating oil base stock as a major component; and a mixture of (i) one or more protected lubricating oil additives comprising a protected phenolic antioxidant, and (ii) one or more unprotected lubricating oil additives comprising an unprotected aminic antioxidant, as a minor component. The one or more protected lubricating oil additives are inactive with respect to their antioxidant function. The method comprises converting the one or more protected lubricating oil additives into one or more unprotected lubricating oil additives in the lubricating oil in-service in an engine or other mechanical component.

As also described herein, this disclosure provides a method for improving oxidative stability of a lubricating oil and extending performance life of lubricating oil additives. The method comprises using as the lubricating oil a formulated oil, the formulated oil having a composition comprising a lubricating oil base stock as a major component; and a mixture of (i) one or more protected lubricating oil additives comprising a protected phenolic antioxidant, and (ii) one or more unprotected lubricating oil additives comprising an unprotected aminic antioxidant, as a minor component. The one or more protected lubricating oil additives are inactive with respect to their antioxidant function. The method comprises converting the one or more protected lubricating oil additives into one or more unprotected lubricating oil additives in the lubricating oil in-service in an engine or other mechanical component.

In an embodiment, oxidative stability is improved and additive performance life is extended as compared to oxidative stability and additive performance life achieved using a lubricating oil containing a minor component other than the lubricating oil additive mixture.

As further described herein, this disclosure provides a composition comprising a mixture of (i) one or more protected lubricating oil additives comprising a protected phenolic antioxidant, and (ii) one or more unprotected lubricating oil additives comprising an unprotected aminic antioxidant. The one or more protected lubricating oil additives can include, for example, a protected hydroxyl-based organic friction modifier comprising tert-butyl octadecane-1,2-diyl dicarbonate, a protected aminic antioxidant comprising tert-butyl diaryl carbamate, a protected phenolic antioxidant comprising di-tert-butyl (methylenebis(2,6-di-tert-butyl-4,1-phenylene)) bis(carbonate), a protected Mannich dispersant comprising a Mannich dispersant having a tert-butyl carbonate group, a protected ester diol friction modifier comprising glycerol monostearate bis(carbonate), and the like.

In another embodiment, solubility of the one or more protected lubricating oil additives in the lubricating oil base stock is improved as compared to solubility achieved using a lubricating oil containing a minor component other than the lubricating oil additive mixture.

Lubricating Oil Base Stocks

A wide range of lubricating base oils is known in the art. Lubricating base oils that are useful in the present disclosure are both natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between 80 to 120 and contain greater than 0.03% sulfur and/or less than 90% saturates. Group II base stocks have a viscosity index of between 80 to 120, and contain less than or equal to 0.03% sulfur and greater than or equal to 90% saturates. Group III stocks have a viscosity index greater than 120 and contain less than or equal to 0.03% sulfur and greater than 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) and GTL products | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked base stocks, including synthetic oils such as polyalphaolefins, alkyl aromatics and synthetic esters are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from 250 to 3,000, although PAO's may be made in viscosities up to 100 cSt (100° C.). The PAOs are typically comprised of relatively low molecular weight hydrogenated polymers or oligomers of alphaolefins which include, but are not limited to, $C_2$ to $C_{32}$ alphaolefins with the $C_8$ to $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example, the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

The hydrocarbyl aromatics can be used as base oil or base oil component and can be any hydrocarbyl molecule that contains at least 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bisphenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from $C_6$ up to $C_{60}$ with a range of $C_8$ to $C_{20}$ often being preferred. A mixture of hydrocarbyl groups is often preferred, and up to three such substituents may be present. The hydrocarbyl group can optionally contain sulfur, oxygen, and/or nitrogen containing substituents. The aromatic group can also be derived from natural (petroleum) sources, provided at least 5% of the molecule is comprised of an above-type aromatic moiety. Viscosities at 100° C. of approximately 3 cSt to 50 cSt are preferred, with viscosities of approximately 3.4 cSt to 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be 2% to 25%, preferably 4% to 20%, and more preferably 4% to 15%, depending on the application.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from 5 to 10 carbon atoms. These esters are widely available commercially, for example, the Mobil P-41 and P-51 esters of ExxonMobil Chemical Company).

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from 2 $mm^2/s$ to 50 $mm^2/s$ (ASTM D445). They are further characterized typically as having pour points of −5° C. to −40° C. or lower (ASTM D97). They are also characterized typically as having viscosity indices of 80 to 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) and hydrodewaxed, or hydroisomerized/cat (and/or solvent) dewaxed base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low sulfur, sulfated ash, and phosphorus (low SAP) products.

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluents/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

The base oil constitutes the major component of the engine oil lubricant composition of the present disclosure and typically is present in an amount ranging from 50 to 99 weight percent, to preferably from 70 to 95 weight percent, and more preferably from 85 to 95 weight percent, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of 2.5 cSt to 12 cSt (or $mm^2/s$) at 100° C. and preferably of 2.5 cSt to 9 cSt (or $mm^2/s$) at 100° C. Mixtures of synthetic and natural base oils may be used if desired.

Protected Lubricating Oil Additives

This disclosure provides a mixture of (i) one or more protected lubricating oil additives comprising a protected phenolic antioxidant, and (ii) one or more unprotected lubricating oil additives comprising an unprotected aminic antioxidant. The one or more protected lubricating oil additives are inactive with respect to their antioxidant function. The one or more protected lubricating oil additives are converted into one or more unprotected lubricating oil additives in the lubricating oil in-service in an engine or other mechanical component.

The one or more protected lubricating oil additives are converted to one or more unprotected lubricating oil additives in the lubricating oil in-service in the engine or other mechanical component at a temperature greater than or equal to 110° C., or by reaction with free acids that catalyze the release of an unprotected lubricating oil additive at a temperature greater than or equal to ambient temperature.

Illustrative unprotected lubricating oil additives include, for example, additives containing an —OH active group, a —NH active group, and the like.

Protection methods for the one or more protected lubricating oil additives can include, for example, chemical protection or physical protection. Illustrative chemical protection includes, for example, converting an unprotected —OH group or —NH group to a protected carbonate, carbamate, acetal, ester, amide, urea, alkoxysilane, alkylsilane, phosphite, phosphonate, phosphate, sulfonamide, sulfonate, or sulfate group. Illustrative physical protection includes, for example, converting one or more unprotected lubricating oil additives into swollen inverse micelles, or incorporating one or more unprotected lubricating oil additives into a stable polar emulsion.

In an embodiment, one or more protected lubricating oil additives include one or more unprotected lubricating oil additives in swollen inverse micelles dispersed in a nonpolar lubricating oil base stock. Illustrative swollen inverse micelles comprise (i) a liquid polar core containing a polar solvent and one or more polar unprotected lubricating oil additives having solubility in the polar solvent, and (ii) a layer of liquid surfactant molecules enclosing the liquid polar core in which polar heads of the liquid surfactant molecules are oriented towards the liquid polar core.

In an embodiment, one or more protected lubricating oil additives include one or more unprotected lubricating oil additives incorporated into a stable polar emulsion in a nonpolar lubricating oil base stock. Illustrative stable polar emulsions comprise a liquid polar core containing a polar solvent and one or more unprotected polar lubricating oil additives having solubility in the polar solvent.

Deprotection methods for converting one or more protected lubricating oil additives to one or more unprotected lubricating oil additives include chemical deprotection or physical deprotection.

Illustrative chemical deprotection methods include, for example, converting a protected carbonate, carbamate, acetal, ester, amide, urea, alkoxysilane, alkylsilane, phosphite, phosphonate, phosphate, sulfonamide, sulfonate, or sulfate group to an unprotected —OH group or —NH group.

Illustrative physical deprotection methods include, for example, releasing the one or more unprotected lubricating oil additives from the (i) swollen inverse micelles or (ii) stable polar emulsion. The one or more unprotected lubricating oil additives in the (i) swollen inverse micelles or (ii) stable polar emulsions are released into the lubricating oil, for example, through diffusion, thermal/oxidative degradation of the (i) swollen inverse micelles or (ii) stable polar emulsions, deformation of the (i) swollen inverse micelles or (ii) stable polar emulsions through high pressures or shear stress, and the like.

Preferred protected lubricating oil additives include a protected phenolic antioxidant, and preferred unprotected lubricating oil additives include an unprotected aminic antioxidant.

Illustrative protected lubricating oil additives include, for example, a protected hydroxyl-based organic friction modifier, a protected aminic antioxidant, a protected phenolic antioxidant, a protected Mannich dispersant, a protected ester diol friction modifier, and the like.

Other illustrative protected lubricating oil additives include, for example, a protected hydroxyl-based organic friction modifier comprising tert-butyl octadecane-1,2-diyl dicarbonate or Vikinol™ 18 bis(carbonate), a protected aminic antioxidant comprising tert-butyl diaryl carbamate or Irganox™ L57 carbamate, a protected phenolic antioxidant comprising di-tert-butyl (methylenebis(2,6-di-tert-butyl-4,1-phenylene)) bis(carbonate) or Ethanox™ 4702 bis(carbonate), a protected Mannich dispersant comprising a Mannich dispersant having a tert-butyl carbonate group, a protected ester diol friction modifier comprising glycerol monostearate bis(carbonate), and the like.

The lubricating oils of this disclosure can further include one or more unprotected lubricating oil additives as described herein. Illustrative of such unprotected lubricating oil additives include, for example, an unprotected viscosity improver, an unprotected antioxidant, an unprotected detergent, an unprotected dispersant, an unprotected pour point depressant, an unprotected corrosion inhibitor, an unprotected friction modifier, an unprotected metal deactivator, an unprotected seal compatibility additive, an unprotected anti-foam agent, an unprotected inhibitor, and an unprotected anti-rust additive.

In the lubricating oils of this disclosure, the one or more lubricating oil additives can be present in an amount from about 0.1 weight percent to about 10 weight percent or greater, preferably from about 0.25 weight percent to about 8 weight percent, more preferably from about 0.5 weight percent to about 5 weight percent, more preferably from about 0.75 weight percent to about 3 weight percent, and more preferably from about 1 weight percent to about 2 weight percent, based on the total weight of the lubricating oil.

Polar Solvents

Illustrative polar solvents useful in the swollen inverse micelles include, for example, glycols, alcohols, esters, ethers, carboxylic acids, amines, and other organic compounds containing one or more polar functional groups (e.g., phosphate, sulfonate, sulfate, silicone). In particular, useful polar solvents include monoethylene glycol, diethylene glycol, triethylene glycol, tetraethylene glycol, polyethylene glycol, triethylene glycol monomethyl ether, triethylene glocol dimethyl ether, tripropylene glycol, tripropylene glycol butyl ether (also known as Dowanol™ TPnB), tripropylene glycol methyl ether (also known as Dowanol™ TPM), diethylene glycol dimethyl ether (also known as diglyme), and the like.

The polar solvent can be present in an amount from 0.1 weight percent to 20 weight percent, preferably from 1 weight percent to 10 weight percent, and more preferably from 2 weight percent to 5 weight percent, based on the total weight of the lubricating oil. The polar solvent is present in the lubricating oil in an amount sufficient to impart solubility to the polar lubricating oil additives, and to form the swollen inverse micelles.

Surfactants

Suitable surfactants useful in this disclosure typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many surfactants may be characterized as phenates, sulfonates, sulfurized phenates, salicylates, naphthenates, stearates, carbamates, thiocarbamates, phosphorus derivatives. A particularly useful class of surfactants are the alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of surfactant are well known commercially and in the literature. Exemplary U.S. patents describing such surfactants are U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of surfactant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of surfactants may be found, for example, in European Patent Application No. 471 071, to which reference is made for this purpose.

Hydrocarbyl-substituted succinic acid and hydrocarbyl-substituted succinic anhydride derivatives are useful surfactants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from 1:1 to 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful surfactant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500. The above products can be post-reacted with various reagents such as sulfur, oxygen, formaldehyde, carboxylic acids such as oleic acid. The above products can also be post reacted with boron compounds such as boric acid, borate esters or highly borated surfactants, to form borated surfactants generally having from 0.1 to 5 moles of boron per mole of surfactant reaction product.

Mannich base surfactants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or HN®2 group-containing reactants.

Hydrocarbyl substituted amine surfactant additives are well known to one skilled in the art; see, for example, U.S. Pat. Nos. 3,275,554; 3,438,757; 3,565,804; 3,755,433, 3,822,209, and 5,084,197.

Other useful surfactants include, for example, carboxylic acids (e.g., oleic acid), alkyl amines (e.g., oleylamine), reaction products of carboxylic acids and alkyl amines (e.g., dialkyl amides), and the like.

Preferred surfactants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5000 or a mixture of such hydrocarbylene groups. Other preferred surfactants include succinic acid-esters and amides, alkylphenol-polyamine-coupled Mannich adducts, their capped derivatives, and other related components. A preferred surfactant is polyisobutylene succinimide polyamine (PIBSA-PAM). Such additives may be used in an amount of 0.1 to 20 weight percent, preferably 0.5 to 8 weight percent.

The surfactant can be present in an amount from 0.1 weight percent to 10 weight percent, preferably from 0.2 weight percent to 5 weight percent, and more preferably from 0.5 weight percent to 2 weight percent, based on the total weight of the lubricating oil. The surfactant is present in the lubricating oil in an amount sufficient to form a layer of liquid surfactant molecules enclosing the liquid polar core in which polar heads of the liquid surfactant molecules are oriented towards the liquid polar core, and to form the swollen inverse micelles.

Polar Lubricating Oil Additives

Illustrative polar lubricating oil additives useful in the swollen inverse micelles include, for example, dispersants, detergents, corrosion inhibitors, rust inhibitors, metal deactivators, antioxidants, anti-wear agents and/or extreme pressure additives, anti-seizure agents, wax modifiers, viscosity index improvers, viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, antifoam agents, and pour point depressants. Illustrative polar lubricating oil additives useful in the swollen inverse micelles include, for example, inorganic lubricating oil additives.

In particular, illustrative polar lubricating oil additives include friction modifiers such as ammonium tetrathiomolybdate, ammonium molybdate, sodium molybdate, sodium molybdenum dehydrate, molybdenum disulfide, molybdenum carbide, molybdenum (VI) oxide, molybdenum di-n-butyl dithiocarbamate, (propylcyclopentadienyl molybdenum tricarbonyl dimer, and the like; also organic and inorganic borated compounds and the like; antioxidants such as butylated hydroxytoluene (BHT), 2,6-di-tert-butyl phenol, 2,6-di-tert-butyl cresol, alkylated diphenylamines, and the like; and anti-wear agents such as zinc dialkyldithiophosphate (ZDDP), tricresyl phosphate, sulfurized olefins, elemental sulfur and compounds which produce sulfur in situ such as ammonium or sodium thiosulfate dissolved in the polar core, and the like.

In general, the polar lubricating oil additives can be present in an amount from 0.05 weight percent to 5 weight percent, preferably from 0.1 weight percent to 2 weight percent, and more preferably from 0.2 weight percent to 1 weight percent, based on the total weight of the lubricating oil. The polar lubricating oil additives are present in the lubricating oil in an amount sufficient to form the polar core and to form the swollen inverse micelles.

Swollen Inverse Micelles

In an embodiment, this disclosure includes a swollen inverse micelle system comprised of a liquid polar solvent core surrounded by a self-assembled layer of liquid surfactant molecules, with a polar head oriented towards the polar solvent core. The liquid polar solvent core may contain one or more polar lubricant additives, including friction modifiers, antioxidants, and corrosion inhibitors, and rust inhibitors. The system provides a method to incorporate oil-insoluble polar lubricant performance additives into a lubricant formulation.

The additives contained in the swollen inverse micelle system are stable in a fully formulated lubricant and will not precipitate or separate over time under normal storage conditions. In application at elevated temperatures, pressures or shear stress, the additives will be slowly released into the oil, through one or more of the following mechanisms: 1) diffusion, 2) thermal/oxidative degradation of the liquid surfactant layer, 3) deformation of the micelle system through high pressures or shear stress.

The micelle system also provides an added level of thermal and oxidative protection to the contained lubricant additives from the external environment, allowing the additives to degrade at a much slower rate, resulting in extended additive performance life. This additive protection can be further enhanced by incorporating a lubricant performance additive along with a polar antioxidant additive within the polar solvent core of the micelle system, to deliver oxidative protection from within the micelle system itself.

The swollen inverse micelle can also be used as a miniature reactor, as it is partially isolated from the bulk environment of the lubricant. The temperatures and pressures inside the micelles could allow for reactions to occur locally, in the internal polar solvent phase. For example, the molybdate friction modifier may be converted to a better friction modifier ($MoS_2$, Mo oxides, etc.) within the micelle than if it was in a bulk phase. Acid base reactions within the micelle could also result in the formation of anti-wear agents such sodium thiosulfate, which is soluble in glycol, and can form colloidal sulfur within the micelle if it sees acid.

A particular set of conditions are needed to form the inverse or reverse micelle systems useful in this disclosure.

First, a critical surfactant concentration as indicated by the critical micelle concentration (CMC) and Dynamic Light Scattering (DLS) data is needed. Typical critical surfactant concentrations can range from about 0.05 wt. % to about 2 wt. %, or from about 0.1 wt. % to about 1.75 wt. %, or from about 0.5 wt. % to about 1.5 wt. %.

Second, a very low interfacial tension is needed. Interfacial tension will be affected by the additives incorporated into the polar solvent core. Without the additives, the micelle has a larger mean diameter and is not optically clear (i.e., there is a haze). However with the molybdate additive, the interfacial tension is significantly reduced, decreasing the mean diameter and allowing the solution to be optically clear. Typical interfacial tension can range from about 0.1 mN/m to about 60 mN/m, or from about 0.5 mN/m to about 30 mN/m, or from about 1 mN/m to about 10 mN/m.

Third, sufficient shear during the manufacturing process of the swollen inverse micelle system is needed to achieve sub-micron size. A microfluidizer is a preferred device that can achieve the desired micelle size (e.g., from about 0.05 to about 0.5 micron mean diameter). Typical shear can range from about 1,000 sec.-1 to about 50,000,000 sec.-1, or from about 20,000 sec.-1 to about 20,000,000, or from about 500,000 sec.-1 to about 10,000,000 sec.-1.

The term "swollen inverse micelles" means inverse micelles comprising a liquid core containing a polar solvent and one or more polar lubricating oil additives having solubility in the polar solvent, and a liquid surfactant or liquid surfactant/polymeric layer (typically polymeric) enclosing the liquid core. When the swollen inverse micelles are sheared, they spontaneously reform at a smaller size (i.e., they are self-healing). The swollen inverse micelles protect the polar lubricating oil additives from negative interactions by isolating them within the liquid core. Additional protection against oxidation is provided by incorporating an antioxidant(s) along with one or more other additives into swollen inverse micelles to extend the useful performance life of the additives. The solubility of polar additives is improved by dissolving the polar additives in a polar solvent which forms the core of the micelle.

The swollen inverse micelles useful in this disclosure are approximately of spherical shape. When speaking in terms of diameter, or size of the swollen inverse micelles, reference is made to their largest dimension. The diameter of the swollen inverse micelles useful in this disclosure is preferably between 0.01 and 50 μm, more preferably between 0.01 and 10 μm, or between 0.01 and 1.5 μm, or between 0.01 and 1 μm, or between 0.01 and 0.75 μm, or between 0.05 and 0.5 μm. It is desirable that the swollen inverse micelles should be of homogeneous size. It is also desirable that the preferably homogeneous size is of the order of a few hundred nanometers, typically less than 1 micron, for example less than 0.75 microns, in particular less than 0.5 microns, so as to provide optical clarity to the lubricating oil.

The dispersion of swollen inverse micelles in a liquid lubricant oil is complex and requires stabilizing the core with a surfactant and achieving sub-micron size (diameter) of the swollen inverse micelles. A very low interfacial tension, as a result of the inorganic friction modifier dissolved in the polar core, is an important factor for achieving sub-micron size. Very high shear rates on the order of $10^7$ $sec^{-1}$ are applied to achieve a desired average particle size (e.g., about 0.05 to about 0.5 μm).

The swollen inverse micelles useful in this disclosure can have a liquid surfactant or liquid surfactant/polymeric shell or membrane enclosing the core. The liquid surfactant or liquid surfactant/polymeric protective shell can insulate the polar solvent and polar lubricating oil additives from the outside environment, providing protection to the polar lubricating oil additives from negative interactions by isolating them within the liquid core, protection against oxidation by incorporating an antioxidant(s) along with one or more other additives in the inverse micelle system to extend the useful performance life of the additives, and improving of polar additives by dissolving the polar additives in a polar solvent which forms the core of the micelle.

The swollen inverse micelles useful in this disclosure can have a core that is surrounded by a liquid surfactant or liquid surfactant/polymeric shell or membrane that is stable to moderate shear and high temperatures. When swollen inverse micelles are sheared, the micelles spontaneously reform at a smaller size (i.e., they are self-healing). At high shear rates, the swollen inverse micelles elongate and form a protective film between the moving contact (e.g., bearing, piston rings, etc.). Also, a protective film is provided that is stable at high temperatures. Further, the film is maintained as the temperature increases while the premium conventional lubricant shows film degradation as temperature increases.

The constituent polymers of the liquid surfactant/polymeric shell of the swollen inverse micelles useful in this disclosure can have good heat resistance (i.e., do not degrade at extreme temperatures which may be encountered when in service, i.e., of the order of 150° C. to 160° C.), and good mechanical strength so that they can withstand the high shear levels encountered in engines. The liquid surfactant/polymeric shell of the swollen inverse micelles useful in this disclosure may be formed for example of polymers of polystyrene sulfonic acid (or salt), polyester, polyamide, polyurethane, polyurea type, or the copolymers thereof, optionally with other monomers, polyacrylonitriles, vinyl resins or aminoplast resins. Polyureas, known for their good properties, are particularly preferred. They also have good mechanical resistance and good heat resistance.

The swollen inverse micelles useful in this disclosure can be prepared by conventional methods known in the art. For example, a polar lubricating oil additive can be mixed with a polar solvent and the resulting product can be added to a lubricating oil base stock. The resulting product can be mixed under low and/or high shear conditions for a time (e.g., from 5 minutes to 2 hours) and at a temperature (e.g., from 15° C. to 80° C.) sufficient to form a homogeneous lubricant containing swollen inverse micelles.

The liquid surfactant/polymeric shell or membrane (typically polymeric) enclosing the solid or liquid core can be prepared by conventional methods known in the art. For example, an oil soluble cross-linking agent can be added to the oil continuous phase after the polar phase is dispersed. Alternatively, the functional groups on additive(s) in the oil continuous phase (such as the polyamine groups on typical surfactants) can be used to react with polymer(s) in the polar core and form a polymer film at the interface.

Polar lubricant additives contained in the swollen inverse micelle system are an alternative method to hard-sphere polymer microencapsulated additives or polymer matrix microencapsulated additives, which may also provide slow release and enhanced thermal and oxidative protection to lubricant additives. However, the inverse micelle systems provide several advantages over the microencapsulated systems.

At high pressure or shear stress, all of these systems (i.e., swollen inverse micelle, hard-sphere polymer microcapsules, and polymer matrix microcapsules) will rupture or divide releasing some additive into the oil. However, unlike the microcapsules, the inverse micelle system is self-healing and the surfactant molecules reform their liquid layer around the polar additive-solvent solution.

When the formulation is comprised of a surfactant level above the CMC for that surfactant, free surfactant molecules will exist in the lubricant, which allows for replacement or exchange of surfactant molecules in the liquid surfactant layer of the micelle system as these molecules begin to thermally or oxidatively degrade. This property helps extend the life of the micelle system.

The surfactant molecules not only serve to deliver and protect polar additives to a lubricant, but they can also serve to disperse high molecular weight oxidation products which reduces engine oil deposit formation and improves the cleanliness performance of the lubricant. Thus, the inverse micelle system is able to provide performance to the lubricant even after the comprised additive is released. On the other hand, the high molecular weight microcapsule polymeric materials left behind after the additive release have not been shown to provide any additional performance benefits and may promote the formation of deposits or reduce oil flow by clogging the oil filter.

The surfactant shell is a permeable membrane that can potentially act as a hydrogen ion trap that neutralizes acid, traps water and other bad byproducts of oxidation and aging.

The swollen inverse micelles are present in the lubricating oil in an amount sufficient to impart to the lubricating oil improved friction reduction and improved engine fuel efficiency. In particular, the swollen inverse micelles can be present in an amount from 0.1 weight percent to 10 weight percent or greater, preferably from 0.25 weight percent to 9.5 weight percent, and more preferably from 0.5 weight percent to 9 weight percent, based on the total weight of the lubricating oil.

Stable Polar Emulsions

In an embodiment, this disclosure includes one or more unprotected lubricating oil additives incorporated into a stable polar emulsion in a nonpolar lubricating oil base stock. Illustrative stable polar emulsions comprise a stable polar emulsion system comprised of a liquid polar core containing a polar solvent and one or more unprotected polar lubricating oil additives having solubility in the polar solvent.

The solubilized additive is stabilized by a surfactant membrane which self-assembles around the polar core. This self-assembled surfactant membrane is stable to shear and self-heals in the presence of an excess surfactant concentration. The resulting polar emulsion can be further stabilized by reducing the particles size of the polar core with shear. This reduction in size will reduce the chances of particles coalescing (Ostwald ripening) to larger particles and settling. Reducing to a very small sub-micron particle size will further stabilize the emulsion, approaching the size of a swollen inverse micelle, and benefiting from the effects of Brownian motion which reduces the probability of settling. This reduced size below 0.1 micron is smaller than the wavelength of visible light and results in a clear complex fluid of two immiscible liquids.

Other Additives

The formulated lubricating oil useful in the present disclosure may additionally contain one or more of the other commonly used lubricating oil performance additives including but not limited to dispersants, detergents, corrosion inhibitors, rust inhibitors, metal deactivators, other anti-wear agents and/or extreme pressure additives, anti-seizure agents, wax modifiers, viscosity index improvers, viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

The types and quantities of performance additives used in combination with the instant disclosure in lubricant compositions are not limited by the examples shown herein as illustrations.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure. Friction modifiers may include metal-containing compounds or materials as well as ashless compounds or materials, or mixtures thereof. Metal-containing friction modifiers may include metal salts or metal ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc. See U.S. Pat. Nos. 5,824,627, 6,232,276, 6,153,564, 6,143,701, 6,110,878, 5,837,657, 6,010,987, 5,906,968, 6,734,150, 6,730,638, 6,689,725, 6,569,820; WO 99/66013; WO 99/47629; and WO 98/26030.

Ashless friction modifiers may also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from 0.01 weight percent to 10-15 weight percent or more, often with a preferred range of 0.1 weight percent to 5 weight percent. Concentrations of molybdenum-containing materials are often described in terms of Mo metal concentration. Advantageous concentrations of Mo may range from 10 ppm to 3000 ppm or more, and often with a preferred range of 20-2000 ppm, and in some instances a more preferred range of 30-1000 ppm. Friction modifiers of all types may be used alone or in mixtures with the materials of this disclosure. Often mixtures of two or more friction modifiers, or mixtures of friction modifier(s) with alternate surface active material(s), are also desirable.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-T-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Preferred antioxidants include hindered phenols, arylamines. These antioxidants may be used individually by type or in combination with one another. Such additives may be used in an amount of 0.01 to 5 weight percent, preferably 0.01 to 1.5 weight percent, more preferably zero to less than 1.5 weight percent, most preferably zero.

Dispersants

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So-called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from 1:1 to 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from 0.1 to 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HN®_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5000 or a mixture of such hydrocarbylene groups. Other preferred dispersants include succinic acid-esters and amides, alkylphenol-polyamine-coupled Mannich adducts, their capped derivatives, and other related components. A preferred dispersant is polyisobutylene succinimide polyamine (PIBSA-PAM). Such additives may be used in an amount of 0.1 to 20 weight percent, preferably 0.5 to 8 weight percent.

Detergents

A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of 1.05:1 to 50:1 on an equivalent basis. More preferably, the ratio is from 4:1 to 25:1. The resulting detergent is an overbased detergent that will typically have a TBN of 150 or higher, often 250 to 450 or more. Preferably, the overbasing cation is sodium, calcium, or magnesium. A mixture of detergents of differing TBN can be used in the present disclosure.

Preferred detergents include the alkali or alkaline earth metal salts of sulfonates, phenates, carboxylates, phosphates, and salicylates, e.g., a mixture of magnesium sulfonate and calcium salicylate.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have 3 to 70 carbon atoms. The alkaryl sulfonates typically contain 9 to 80 carbon or more carbon atoms, more typically from 16 to 60 carbon atoms.

Alkaline earth phenates are another useful class of detergent. These detergents can be made by reacting alkaline earth metal hydroxide or oxide ($CaO$, $Ca(OH)_2$, $BaO$, $Ba(OH)_2$, $MgO$, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

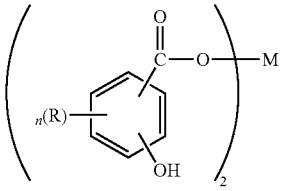

where R is an alkyl group having 1 to 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Preferred detergents include calcium phenates, calcium sulfonates, calcium salicylates, magnesium phenates, magnesium sulfonates, magnesium salicylates and other related components (including borated detergents) in any combination. A preferred detergent includes magnesium sulfonate and calcium salicylate.

The detergent concentration in the lubricating oils of this disclosure can range from 1.0 to 6.0 weight percent, preferably 2.0 to 5.0 weight percent, and more preferably from 2.0 weight percent to 4.0 weight percent, based on the total weight of the lubricating oil.

Anti-Wear Additives

A metal alkylthiophosphate and more particularly a metal dialkyl dithio phosphate in which the metal constituent is zinc, or zinc dialkyl dithio phosphate (ZDDP) is a component of the lubricating oils of this disclosure. ZDDP can be primary, secondary or mixtures thereof. ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

The ZDDP is typically used in amounts of from 0.4 weight percent to 1.2 weight percent, preferably from 0.5 weight percent to 1.0 weight percent, and more preferably from 0.6 weight percent to 0.8 weight percent, based on the total weight of the lubricating oil, although more or less can often be used advantageously. Preferably, the ZDDP is a secondary ZDDP and present in an amount of from 0.6 to 1.0 weight percent of the total weight of the lubricating oil.

ZDDP is one of the most successful anti-wear additives ever used in lubricants. This additive is fairly cost effective and provides exceptionally durable anti-wear tribofilms on ferrous surfaces under extreme lubrication conditions. ZDDP forms protective films on ferrous surfaces within a very short period of time. This additive forms pad-like polymeric tribofilms at the rubbing contact and thus prevents wear. It is believed that ZDDP undergoes thermal decomposition at the tribological contact followed by the reactions with reactive iron surfaces or iron oxides that forms glassy phosphate films. These films contain minimal iron meaning that the formation of tribofilm requires minimal loss of iron from the rubbed surfaces. The chain lengths of the phosphate decreases with the depth of the tribofilm and the layers near the surface were mostly dominated by iron sulphides and iron oxides.

Using an optical interferometry technique, it has been demonstrated that the formation of ZDDP tribofilm takes several tens of minutes. The friction coefficients during the film formation period initially increases and then gradually decreases and finally reaches to steady sate. The increase of friction is a result of initial wear (adhesive/abrasive wear) that generates enough nascent iron to react with the thermally decomposed ZDDP. As soon as the ZDDP tribofilm starts to dominate the contact between two interacting surfaces, friction starts to decrease. Since the film formation of ZDDP is primarily influenced by the initial wear, the nature of wear influences the uniformity as well as growth rate of ZDDP tribofilm to a great extent.

Uniform anti-wear tribofilms are desirable over the non-uniform patchy tribofilms. This is because the uniform tribofilm can resist the applied load more uniformly and thereby generates distributed stresses within the tribofilm. In contrast, in the case of non-uniform tribofilms, the applied load is mainly taken by the high spots resulting in more concentrated stresses and thereby causing more failure of tribofilms. This disclosure reveals that NGP materials enable the formation of uniform ZDDP tribofilms by controlling the initial wear process.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. Such additives may be used in an amount of 0.01 to 5 weight percent, preferably 0.01 to 1.5 weight percent.

Seal Compatibility Agents

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of 0.01 to 3 weight percent, preferably 0.01 to 2 weight percent.

Antifoam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 weight percent and often less than 0.1 weight percent.

Viscosity Index Improvers

Viscosity index improvers (also known as VI improvers, viscosity modifiers, and viscosity improvers) can be included in the lubricant compositions of this disclosure. Preferably, the method of this disclosure obtains improvements in fuel economy without sacrificing durability by a reduction of high-temperature high-shear (HTHS) viscosity to a level lower than 2.6 cP through reduction or removal of viscosity index improvers or modifiers.

Viscosity index improvers provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between 10,000 to 1,500,000, more typically 20,000 to 1,200,000, and even more typically between 50,000 and 1,000,000.

Examples of suitable viscosity index improvers are linear or star-shaped polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers, are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Polyisoprene polymers are commercially available from Infineum International Limited, e.g. under the trade designation "SV200"; diene-styrene copolymers are commercially available from Infineum International Limited, e.g. under the trade designation "SV 260".

In an embodiment of this disclosure, the viscosity index improvers may be used in an amount of less than 2.0 weight percent, preferably less than 1.0 weight percent, and more preferably less than 0.5 weight percent, based on the total weight of the formulated oil or lubricating engine oil.

In another embodiment of this disclosure, the viscosity index improvers may be used in an amount of from 0.0 to 2.0 weight percent, preferably 0.0 to 1.0 weight percent, and more preferably 0.0 to 0.5 weight percent, based on the total weight of the formulated oil or lubricating engine oil.

When lubricating oil compositions contain one or more of the additives discussed above, the additive(s) are blended into the composition in an amount sufficient for it to perform its intended function. Typical amounts of such additives useful in the present disclosure are shown in Table A below.

It is noted that many of the additives are shipped from the additive manufacturer as a concentrate, containing one or more additives together, with a certain amount of base oil diluents. Accordingly, the weight amounts in the table below, as well as other amounts mentioned in this specification, are directed to the amount of active ingredient (that is the non-diluent portion of the ingredient). The weight percent (wt %) indicated below is based on the total weight of the lubricating oil composition.

TABLE 1

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 1.0-6.0 | 2.0-4.0 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Index Improver (solid polymer basis) | 0.0-2 | 0.0-1 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The following non-limiting examples are provided to illustrate the disclosure.

EXAMPLES

The following examples illustrate the combination of an aminic antioxidant and a protected phenolic antioxidant resulting in an increase in the oxidative life of a lubricant. For the examples, the testing used defines oxidative life as the time it takes for a lubricant to reach a 200% increase in the kinematic viscosity measured at 100° C. The oxidation test has the following operational parameters: sample volume: 11 g; air flow: 120 sccm; catalyst: 50 ppm Fe, in the form of soluble $Fe(acac)_3$; and test temperature: specified in each example.

Example 1

0.75 wt % of an alkylated diphenylamine, an aminic antioxidant, was combined with 0.75 wt % of 4,4'-methylenebis(2,6-di-tert-butylphenol), a phenolic antioxidant, in 15% alkylated naphthalene base oil and 83.5 wt % polyalphaolefin base oil. As detailed in Table 2 below, when all of the —OH active groups of the phenolic antioxidant are initially chemically protected using the carbonate protection method, there is a decrease in oxidative life from 41.6 to 37 hours (shorter time to break, entry 1 and 2). However, when the active —OH groups of the phenolic antioxidant are only partially protected (≤47%), the time to break increases from 37 to 46.5 hours and the oxidative life is improved by 11.8% when compared to the control (41.6 hours, entry 1). Test temperature was 160° C. In this example, the carbonate protecting group for the —OH active groups of the phenolic antioxidant was derived from tert-butoxycarbonyl group (t-Boc).

Table 2 details the comparative oxidative performance at 160° C. of a mixture of 0.75 wt % aminic antioxidant and 0.75 wt % phenolic antioxidant where (i) the phenolic antioxidant is 100% unprotected (entry 1), (ii) the phenolic antioxidant is 100% chemically protected (entry 2), and (iii) the phenolic antioxidant is partially unprotected (0.4 wt %) and partially chemically protected (0.35 wt %) (entry 3).

TABLE 2

Oxidative stability of different combination of unprotected aminic antioxidant and protected/unprotected phenolic antioxidant in base oils (alkylated naphthalene and polyalphaolefin) at 160° C.

| Entry | Type of Antioxidants | Time to Break (hours) |
|---|---|---|
| 1 | 0.75 wt % Aminic AO + 0.75 wt % Phenolic AO | 41.6 |
| 2 | 0.75 wt % Aminic AO + 0.75 wt % Chemically Protected Phenolic AO | 37.0 |
| 3 | 0.75 wt % Aminic AO + 0.4 wt % Phenolic AO + 0.35 wt % Chemically Protected Phenolic AO | 46.5 |

Example 2

0.75 wt % of an alkylated diphenylamine, an aminic antioxidant, was combined with 0.75 wt % of 4,4'-methylenebis(2,6-di-tert-butylphenol), a phenolic antioxidant, in a partially formulated engine oil. As detailed in Table 3 below, when all of the —OH active groups of the phenolic antioxidant are initially chemically protected using the carbonate protection method, there is an unexpected increase in oxidative life from 59.1 to 65.5 hours (longer time to break, entry 1 and 2). Still, when the active —OH groups of the phenolic antioxidant are only partially protected at 47% (entry 3), 73% (entry 4), and 87% level (entry 5), the times to break (63.9, 64.9 and 66.4 hours, respectively) are higher than that of the control (59.1 hours, entry 1). This example illustrates that the beneficial effect of a protected phenolic antioxidant on improving oxidative life of a partially formulated engine oil. Test temperature was 170° C. In this example, the carbonate protecting group for the —OH active groups of the phenolic antioxidant was derived from tert-butoxy carbonyl group (t-Boc).

Table 3 details the comparative oxidative performance at 170° C. of a mixture of 0.75 wt % aminic antioxidant and 0.75 wt % phenolic antioxidant where (i) the phenolic antioxidant is 100% unprotected (entry 1), (ii) the phenolic antioxidant is 100% chemically protected (entry 2), (iii) the phenolic antioxidant is partially unprotected (0.4 wt %) and partially chemically protected (0.35 wt %) (entry 3), (iv) the phenolic antioxidant is partially unprotected (0.2 wt %) and partially chemically protected (0.55 wt %) (entry 4), (v) the phenolic antioxidant is partially unprotected (0.1 wt %) and partially chemically protected (0.65 wt %) (entry 5).

TABLE 3

Oxidative stability of different combination of unprotected aminic antioxidant and protected/unprotected phenolic antioxidant in partially formulated engine oil at 170° C.

| Entry | Type of Antioxidants | Time to Break (hours) |
|---|---|---|
| 1 | 0.75 wt % Aminic AO + 0.75 wt % Phenolic AO | 59.1 |
| 2 | 0.75 wt % Aminic AO + 0.75 wt % Chemically Protected Phenolic AO | 65.5 |
| 3 | 0.75 wt % Aminic AO + 0.4 wt % Phenolic AO + 0.35 wt % Chemically Protected Phenolic AO | 63.9 |
| 4 | 0.75 wt % Aminic AO + 0.2 wt % Phenolic AO + 0.55 wt % Chemically Protected Phenolic AO | 64.9 |
| 5 | 0.75 wt % Aminic AO + 0.1 wt % Phenolic AO + 0.65 wt % Chemically Protected Phenolic AO | 66.4 |

Example 3

0.4 wt % of an alkylated diphenylamine, an aminic antioxidant, was combined with 1.38 wt % of alkyl 3-(3,5-di-tert-butyl-4-hydroxyphenyl)-propanoate, a phenolic antioxidant, in a partially formulated engine oil. As detailed in Table 4 below, when all of the —OH active groups of the phenolic antioxidant are initially chemically protected using the carbonate protection method, there is an unexpected increase in oxidative life from 35.3 to 41.7 hours (longer time to break, entry 1 and 2). Still, when the active —OH groups of the phenolic antioxidant are only partially protected at 47% (entry 3), the time to break (40.5 hours) is higher than that of the control (35.3 hours, entry 1). This example illustrates that the beneficial effect of a protected phenolic antioxidant on improving oxidative life of a partially formulated engine oil. Test temperature was 170° C. In this example, the carbonate protecting group for the —OH active groups of the phenolic antioxidant was derived from tert-butoxycarbonyl group (t-Boc).

Table 4 details the comparative oxidative performance at 170° C. of a mixture of 0.4 wt % aminic antioxidant and 1.38 wt % phenolic antioxidant where (i) the phenolic antioxidant is 100% unprotected (entry 1), (ii) the phenolic antioxidant is 100% chemically protected (entry 2), and (iii) the phenolic antioxidant is partially unprotected (0.73 wt %) and partially chemically protected (0.65 wt %) (entry 3).

TABLE 4

Oxidative stability of different combination of unprotected aminic antioxidant and protected/unprotected phenolic antioxidant in partially formulated engine oil at 170° C.

| Entry | Type of Antioxidants | Time to Break (hours) |
|---|---|---|
| 1 | 0.4 wt % Aminic AO + 1.38 wt % Phenolic AO | 35.3 |
| 2 | 0.4 wt % Aminic AO + 1.38 wt % Chemically Protected Phenolic AO | 41.7 |
| 3 | 0.4 wt % Aminic AO + 0.73 wt % Phenolic AO + 0.65 wt % Chemically Protected Phenolic AO | 40.5 |

Example 4

Oxidative performance of 0.75 wt % diphenylamine based antioxidant in a formulated engine oil was compared to the same formulation with 0.75 wt % butylated hydroxytoluene (BHT), a phenolic antioxidant, added in unprotected versus micelle protected form. The formulated engine oil was comprised of 13.46 wt % of a dispersant/inhibitor (DI)

package, 5 wt % alkylated naphthalene Group V base oil, and a balance of Group III+/IV base oil. As detailed in Table 3 below, when the engine oil is formulated with the unprotected phenolic based antioxidant, it results in a similar performance to that with the diphenylamine based antioxidant alone. Yet by protecting the phenolic-based antioxidant in the polar core of a swollen micelle system, a 90% improvement in oxidative life is observed over the system with just the aminic antioxidant, and an 80% improvement in oxidative life over the system containing the aminic antioxidant and the neat phenolic antioxidant.

Table 5 details the comparative oxidative performance at 170° C. of (i) 0.75 wt % aminic antioxidant and (ii) a mixture of 0.75 wt % aminic antioxidant and 0.75 wt % phenolic antioxidant wherein the 0.75 wt % phenolic antioxidant is (a) 100% unprotected and (b) 100% physically protected.

TABLE 5

| | Time to Break, hrs |
|---|---|
| 0.75 wt % Aminic AO | 29.7 |
| 0.75 wt % Aminic AO + 0.75 wt % Phenolic AO | 32.4 |
| 0.75 wt % Aminic AO + 0.75 wt % Physically Protected Phenolic AO | 56.3 |

PCT and EP Clauses:

1. A lubricating oil comprising a lubricating oil base stock as a major component; and a mixture of (i) one or more protected lubricating oil additives comprising a protected phenolic antioxidant, and (ii) one or more unprotected lubricating oil additives comprising an unprotected aminic antioxidant, as a minor component; wherein the one or more protected lubricating oil additives are inactive with respect to their antioxidant function; and wherein the one or more protected lubricating oil additives are converted into one or more unprotected lubricating oil additives in the lubricating oil in-service in an engine or other mechanical component.

2. The lubricating oil of clause 1 wherein the protected phenolic antioxidant comprises di-tert-butyl (methylenebis (2,6-di-tert-butyl-4,1-phenylene)) bis(carbonate), and the unprotected aminic antioxidant comprises diphenylamine.

3. The lubricating oil of clauses 1 and 2 wherein the one or more protected lubricating oil additives further comprise a protected hydroxyl-based organic friction modifier, a protected aminic antioxidant, a protected Mannich dispersant, or a protected ester diol friction modifier.

4. The lubricating oil of clauses 1-3 wherein the one or more protected lubricating oil additives further comprise a protected hydroxyl-based organic friction modifier comprising tert-butyl octadecane-1,2-diyl dicarbonate, a protected aminic antioxidant comprising tert-butyl diaryl carbamate, a protected Mannich dispersant comprising a Mannich dispersant having a tert-butyl carbonate group, or a protected ester diol friction modifier comprising glycerol monostearate bis (carbonate).

5. The lubricating oil of clauses 1-4 wherein the one or more unprotected lubricating oil additives further comprise an unprotected viscosity improver, an unprotected antioxidant, an unprotected detergent, an unprotected dispersant, an unprotected pour point depressant, an unprotected corrosion inhibitor, an unprotected friction modifier, an unprotected metal deactivator, an unprotected seal compatibility additive, an unprotected anti-foam agent, an unprotected inhibitor, or an unprotected anti-rust additive.

6. The lubricating oil of clauses 1-5 wherein protection for the one or more protected lubricating oil additives comprises chemical protection or physical protection.

7. The lubricating oil of clauses 1-6 wherein chemical protection comprises converting an unprotected —OH group or —NH group to a protected carbonate, carbamate, acetal, ester, amide, urea, alkoxysilane, alkylsilane, phosphite, phosphonate, phosphate, sulfonamide, sulfonate, or sulfate group.

8. The lubricating oil of clauses 1-6 wherein the physical protection comprises incorporating one or more lubricating oil additives into (i) swollen inverse micelles or (ii) stable polar emulsions.

9. The lubricating oil of clauses 1-8 wherein the one or more lubricating oil additives comprise unprotected lubricating oil additives or protected lubricating oil additives.

10. The lubricating oil of clauses 1-9 wherein deprotection for the one or more protected lubricating oil additives comprises chemical deprotection or physical deprotection.

11. The lubricating oil of clauses 1-10 wherein the chemical deprotection comprises the conversion of the one or more protected lubricating oil additives to one or more unprotected lubricating oil additives in the lubricating oil in-service in the engine or other mechanical component at a temperature greater than or equal to 110° C., or by reaction with free acids that catalyze the release of an unprotected lubricating oil additive at a temperature greater than or equal to ambient temperature.

12. The lubricating oil of clauses 1-11 wherein the physical deprotection comprises to releasing the one or more lubricating oil additives from (i) swollen inverse micelles or (ii) stable polar emulsions.

13. A method for controlled release of one or more lubricating oil additives into a lubricating oil, said method comprising:

using as the lubricating oil a formulated oil, said formulated oil having a composition comprising a lubricating oil base stock as a major component; and a mixture of (i) one or more protected lubricating oil additives comprising a protected phenolic antioxidant, and (ii) one or more unprotected lubricating oil additives comprising an unprotected aminic antioxidant, as a minor component; wherein the one or more protected lubricating oil additives are inactive with respect to their antioxidant function; and converting the one or more protected lubricating oil additives into one or more unprotected lubricating oil additives in the lubricating oil in-service in an engine or other mechanical component.

14. A composition comprising a mixture of (i) one or more protected lubricating oil additives comprising a protected phenolic antioxidant, and (ii) one or more unprotected lubricating oil additives comprising an unprotected aminic antioxidant.

15. A method for improving oxidative stability of a lubricating oil and extending performance life of one or more lubricating oil additives, said method comprising:

using as the lubricating oil a formulated oil, said formulated oil having a composition comprising a lubricating oil base stock as a major component; and a mixture of (i) one or more protected lubricating oil additives comprising a protected phenolic antioxidant, and (ii) one or more unprotected lubricating oil additives comprising an unprotected aminic antioxidant, as a minor component; wherein the one or more protected lubricating oil additives are inactive with respect to their antioxidant function; and converting the one or more protected lubricating oil additives into one or more unprotected lubricating oil additives in the lubricating oil in-service in an engine or other mechanical component.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A lubricating oil comprising a lubricating oil base stock as a major component; and a mixture of (i) one or more chemically protected lubricating oil additives comprising a chemically protected phenolic antioxidant, and (ii) one or more unprotected lubricating oil additives comprising an unprotected aminic antioxidant, as a minor component; wherein the one or more chemically protected lubricating oil additives are inactive with respect to their antioxidant function; and wherein the one or more chemically protected lubricating oil additives are converted into one or more unprotected lubricating oil additives comprising an active —OH or a —NH group in the lubricating oil in-service in an engine or other mechanical component.

2. The lubricating oil of claim 1 wherein the chemically protected phenolic antioxidant comprises di-tert-butyl (methylenebis(2,6-di-tert-butyl-4,1-phenylene)) bis(carbonate), and the unprotected aminic antioxidant comprises diphenylamine.

3. The lubricating oil of claim 1 wherein the one or more chemically protected lubricating oil additives further comprise a protected hydroxyl-based organic friction modifier, a protected aminic antioxidant, a protected Mannich dispersant, or a protected ester diol friction modifier.

4. The lubricating oil of claim 1 wherein the one or more chemically protected lubricating oil additives further comprise a protected hydroxyl-based organic friction modifier comprising tert-butyl octadecane-1,2-diyl dicarbonate, a protected aminic antioxidant comprising tert-butyl diaryl carbamate, a protected Mannich dispersant comprising a Mannich dispersant having a tert-butyl carbonate group, or a protected ester diol friction modifier comprising glycerol monostearate bis(carbonate).

5. The lubricating oil of claim 1 wherein the one or more unprotected lubricating oil additives further comprise an unprotected viscosity improver, an unprotected antioxidant, an unprotected detergent, an unprotected dispersant, an unprotected pour point depressant, an unprotected corrosion inhibitor, an unprotected friction modifier, an unprotected metal deactivator, an unprotected seal compatibility additive, an unprotected anti-foam agent, an unprotected inhibitor, or an unprotected anti-rust additive.

6. The lubricating oil of claim 1 wherein chemical protection comprises converting an unprotected —OH group or —NH group to a protected carbonate, carbamate, acetal, ester, amide, urea, alkoxysilane, alkylsilane, phosphite, phosphonate, phosphate, sulfonamide, sulfonate, or sulfate group.

7. The lubricating oil of claim 1 wherein deprotection for the one or more chemically protected lubricating oil additives comprises chemical deprotection or physical deprotection.

8. The lubricating oil of claim 7 wherein the chemical deprotection comprises the conversion of the one or more chemically protected lubricating oil additives to one or more unprotected lubricating oil additives in the lubricating oil in-service in the engine or other mechanical component at a temperature greater than or equal to 110° C., or by reaction with free acids that catalyze the release of an unprotected lubricating oil additive at a temperature greater than or equal to ambient temperature.

9. The lubricating oil of claim 7 wherein the chemical deprotection comprises converting a protected carbonate, carbamate, acetal, ester, amide, urea, alkoxysilane, alkylsilane, phosphite, phosphonate, phosphate, sulfonamide, sulfonate, or sulfate group to an unprotected —OH group or —NH group.

10. The lubricating oil of claim 1 wherein the lubricating oil base stock comprises a Group I, Group II, Group III, Group IV or Group V base oil.

11. The lubricating oil of claim 1 wherein the lubricating oil base stock is present in an amount from 70 weight percent to 95 weight percent, and the one or more lubricating oil additives are present in an amount from 0.1 weight percent to 10 weight percent or greater, based on the total weight of the lubricating oil.

12. The lubricating oil of claim 1 which is used in automotive, marine, aviation, and industrial engine and machine component applications.

13. A method for controlled release of one or more lubricating oil additives into a lubricating oil, said method comprising:

using as the lubricating oil a formulated oil, said formulated oil having a composition comprising a lubricating oil base stock as a major component; and a mixture of (i) one or more chemically protected lubricating oil additives comprising a chemically protected phenolic antioxidant, and (ii) one or more unprotected lubricating oil additives comprising an unprotected aminic antioxidant, as a minor component; wherein the one or more chemically protected lubricating oil additives are inactive with respect to their antioxidant function; and converting the one or more chemically protected lubricating oil additives into one or more unprotected lubricating oil additives comprising an active —OH or a —NH group in the lubricating oil in-service in an engine or other mechanical component.

14. The method of claim 13 wherein the chemically protected phenolic antioxidant comprises di-tert-butyl (methylenebis(2,6-di-tert-butyl-4,1-phenylene)) bis(carbonate), and the unprotected aminic antioxidant comprises diphenylamine.

15. The composition of claim 13 wherein chemical protection comprises converting an unprotected —OH group or —NH group to a protected carbonate, carbamate, acetal, ester, amide, urea, alkoxysilane, alkylsilane, phosphite, phosphonate, phosphate, sulfonamide, sulfonate, or sulfate group.

16. A method for improving oxidative stability of a lubricating oil and extending performance life of one or more lubricating oil additives, said method comprising:

using as the lubricating oil a formulated oil, said formulated oil having a composition comprising a lubricating oil base stock as a major component; and a mixture of (i) one or more chemically protected lubricating oil additives comprising a chemically protected phenolic antioxidant, and (ii) one or more unprotected lubricating oil additives comprising an unprotected aminic antioxidant, as a minor component; wherein the one or more chemically protected lubricating oil additives are inactive with respect to their antioxidant function; and converting the one or more chemically protected lubricating oil additives into one or more unprotected lubricating oil additives comprising an active —OH or a —NH group in the lubricating oil in-service in an engine or other mechanical component.

17. The method of claim 16 wherein the chemically protected phenolic antioxidant comprises di-tert-butyl (methylenebis(2,6-di-tert-butyl-4,1-phenylene)) bis(carbonate), and the unprotected aminic antioxidant comprises diphenylamine.

18. The method of claim 16 wherein oxidative stability is improved and additive performance life is extended as compared to oxidative stability and additive performance life achieved using a lubricating oil containing a minor component other than a mixture of (i) one or more chemically protected lubricating oil additives comprising a chemically protected phenolic antioxidant, and (ii) one or more unprotected lubricating oil additives comprising an unprotected aminic antioxidant.

* * * * *